US005996883A

United States Patent [19]

Bates

[11] Patent Number: 5,996,883

[45] **Date of Patent: *Dec. 7, 1999**

[54] CARTON AND A HANDLE THEREFOR

[75] Inventor: Aaron Bates, Marietta, Ga.

[73] Assignee: The Mead Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/871,926

[22] Filed: Jun. 10, 1997

[51] Int. Cl.[6] ..... B65D 5/46

[52] U.S. Cl. ..... 229/117.13; 229/117.12

[58] Field of Search ..... 206/140, 141, 206/427, 434; 229/117.12, 117.13

[56] References Cited

U.S. PATENT DOCUMENTS

| | | | |
|---|---|---|---|
| 2,225,822 | 12/1940 | Crook | 229/117.13 |
| 3,994,432 | 11/1976 | Kirby, Jr. | 206/141 |
| 4,029,207 | 6/1977 | Gordon | 229/103.2 |
| 4,447,004 | 5/1984 | House et al. | 229/117.13 |
| 4,478,334 | 10/1984 | Graser | 206/427 |
| 5,307,932 | 5/1994 | Stout et al. | 206/141 |
| 5,320,277 | 6/1994 | Stout et al. | 229/117.13 |
| 5,427,242 | 6/1995 | Oliff et al. | 206/430 |
| 5,482,203 | 1/1996 | Stout | 229/117.13 |
| 5,647,483 | 7/1997 | Harris | 206/427 |

*Primary Examiner*—Gary E. Elkins
*Attorney, Agent, or Firm*—Thomas A. Boshinski

[57] ABSTRACT

A carton formed from sheet material for containers such as cans or bottles includes a top wall, a pair of side walls, and a bottom wall interconnected to complete a tubular structure. A notional strip defined along the top wall extends between the end edges of the top wall, and has a width less than the distance between said the side edges of the top wall. A pair of finger apertures are defined in the top panel and disposed along one side of the notional strip, while a thumb aperture is defined in the top panel and disposed along an opposite side of the notional strip. The pair of finger apertures define therebetween a bridge of the sheet material, with the thumb aperture being disposed substantially across the notional strip from said bridge.

9 Claims, 6 Drawing Sheets

CARTON AND A HANDLE THEREFOR

BACKGROUND OF THE INVENTION

The present invention relates generally to paperboard cartons for use in packaging articles. It is particularly useful for cartons for packaging containers such as cans or bottles for beverages, although the invention is not limited in this regard. More particularly, the invention relates to a handle for such cartons.

Containers such as cans or bottles for beverages including soft drink, beer, juices and the like are commonly sold in multiple quantities packaged in a paperboard carton. For the convenience of the consumer, the carton is often provided with a handle, which quite commonly includes as a primary feature one or two slots or other apertures formed in the carton. These slots are commonly formed in top wall of the carton. The user inserts the hand or fingers into one or both of the slots to lift the carton. Many varieties of handles of this type are known in the art.

Lifting a carton containing beverage cans or bottles introduces considerable stress into the paperboard from which the carton is formed. For this reason, to prevent tearing of the paperboard and failure of the carton, a large number of carton handles have been devised over the years which include various reinforcement structures, aperture arrangements and locations, stress-directing fold lines, stress-relieving slits and the like.

Recently, attempts have been made to introduce into the marketplace beverage cartons wherein cans are arranged in two tiers, with corresponding cans from each tier being axially aligned. An example of such a carton can be seen by reference to U.S. Pat. No. 5,427,242. Such cartons are intended to hold relatively large numbers of cans, for example 24 to 36 cans. The contained weight of these cartons makes use of reinforced handle structures particularly advantageous.

Moreover, despite the many handle designs which have been previously developed, there is always a need for handles with improved performance. A stronger handle permits the use of larger cartons for packaging heavier loads, as well as the possibility of a smaller blank or lighter paperboard material. In view of the large numbers of cartons which are produced, the costs savings which can be realized from these latter advantages can be significant.

SUMMARY OF THE INVENTION

In accordance with one embodiment, the present invention provides a carton formed from sheet material for containers such as cans or bottles, including a top wall having opposed side edges and opposed end edges, and a pair of side walls, one of the side walls being connected to each side edge of the top wall. A bottom wall is connected between the side walls to complete a tubular structure. A notional strip is defined along the top wall and extends between the end edges and has a width less than the distance between the side edges. A pair of finger apertures are defined in the top panel and disposed along one side of the notional strip. A thumb aperture is defined in the top panel and disposed along an opposite side of the notional strip.

The pair of finger apertures may define therebetween a bridge of sheet material, the thumb aperture being disposed substantially across the notional strip from the bridge.

A reinforcing strip may be secured to an inner surface of the top panel, the reinforcing strip being disposed generally along the notional strip.

The top panel may define therein a first reinforcing score structure extending substantially from a first of the pair of finger holes to an adjacent corner of the top panel, a second reinforcing score structure extending substantially from a second of the pair of finger holes to an adjacent corner of the top panel, and third and fourth reinforcing score structures extending substantially from the thumb aperture to two adjacent corners of the top panel respectively. In such a case, the reinforcing score structures may each include a plurality of score lines defined on the top panel, the score lines arranged to extend from the respective one of the apertures to the respective one of the corners in a diverging arrangement.

Each of the finger apertures may be covered by a cover flap, each cover flap being connected along one side thereof to the top panel by a fold line. The fold lines connecting the cover flaps to the top panel may be disposed generally along an edge of the notional strip.

The thumb aperture may be covered by a cover flap, the cover flap being connected along one side thereof to the top panel by a fold line. The fold line connecting the cover flap to the top panel may be disposed generally along an edge of the notional strip.

DETAILED DESCRIPTION OF THE PREFERRED EMBODIMENT

Figure 1:
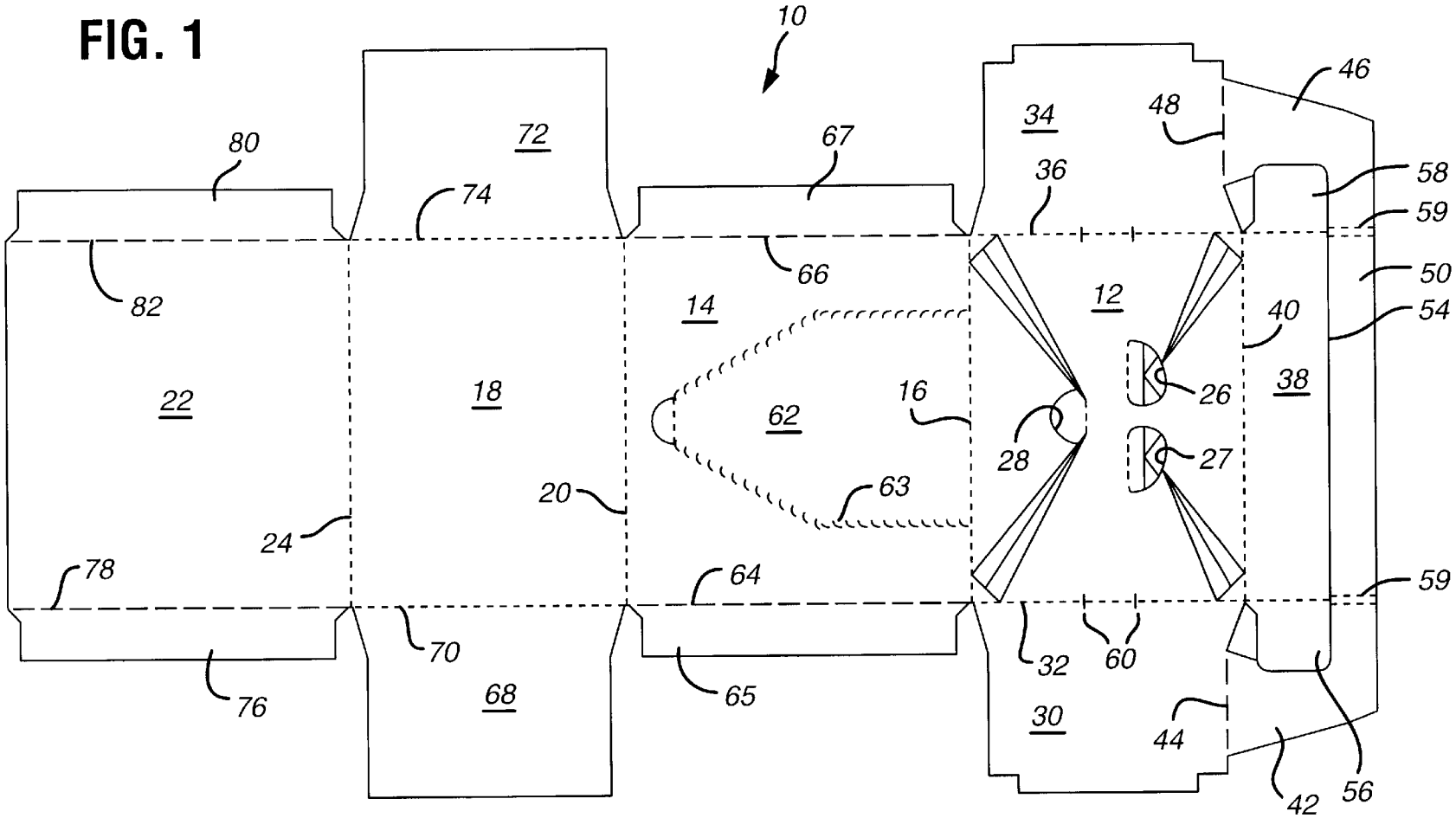
FIG. 1 is a plan view of the inner surface of a blank for forming a carton having a handle in accordance with the present invention.

A carton 10 for use in connection with the present invention may be seen in blank form by reference to FIG. 1, in which the inner surface of the blank is shown. The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

Side wall panel 14 includes a removable access panel 62 defined by a perforated tear line 63. Connected at one end edge of side wall panel 14 along fold line 64 is a minor end flap 65, and connected by a fold line 66 at an opposite end edge is minor end flap 67.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

Top wall panel 12 includes a pair of finger apertures 26 and 27 and a thumb aperture 28 for forming a portion of a handle structure for the carton. These apertures and other portions of the handle structure are discussed in greater detail below.

A handle reinforcing structure in accordance with the present invention is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. Central portion 50 is positioned adjacent to glue flap 38, separated therefrom along a cut line 54.

Glue flap 38 includes end flap 56 which extends into end portion 42, and end flap 58 which extends into end portion 46.

End portions 42 and 46 are connected to the central portion 50 of the reinforcing strip along fold lines 59 which are debossed so as to protrude inwardly of the erected carton. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. Pat. No. 5,320,277, which is incorporated herein by reference.

An additional reinforcing strip (not shown) may optionally be added to the handle reinforcing structure, disposed between central portion 50 and glue flap 38. Such a reinforcing structure may be seen in U.S. Pat. No. 5,482,203, which is incorporated herein by reference.

Figure 2:
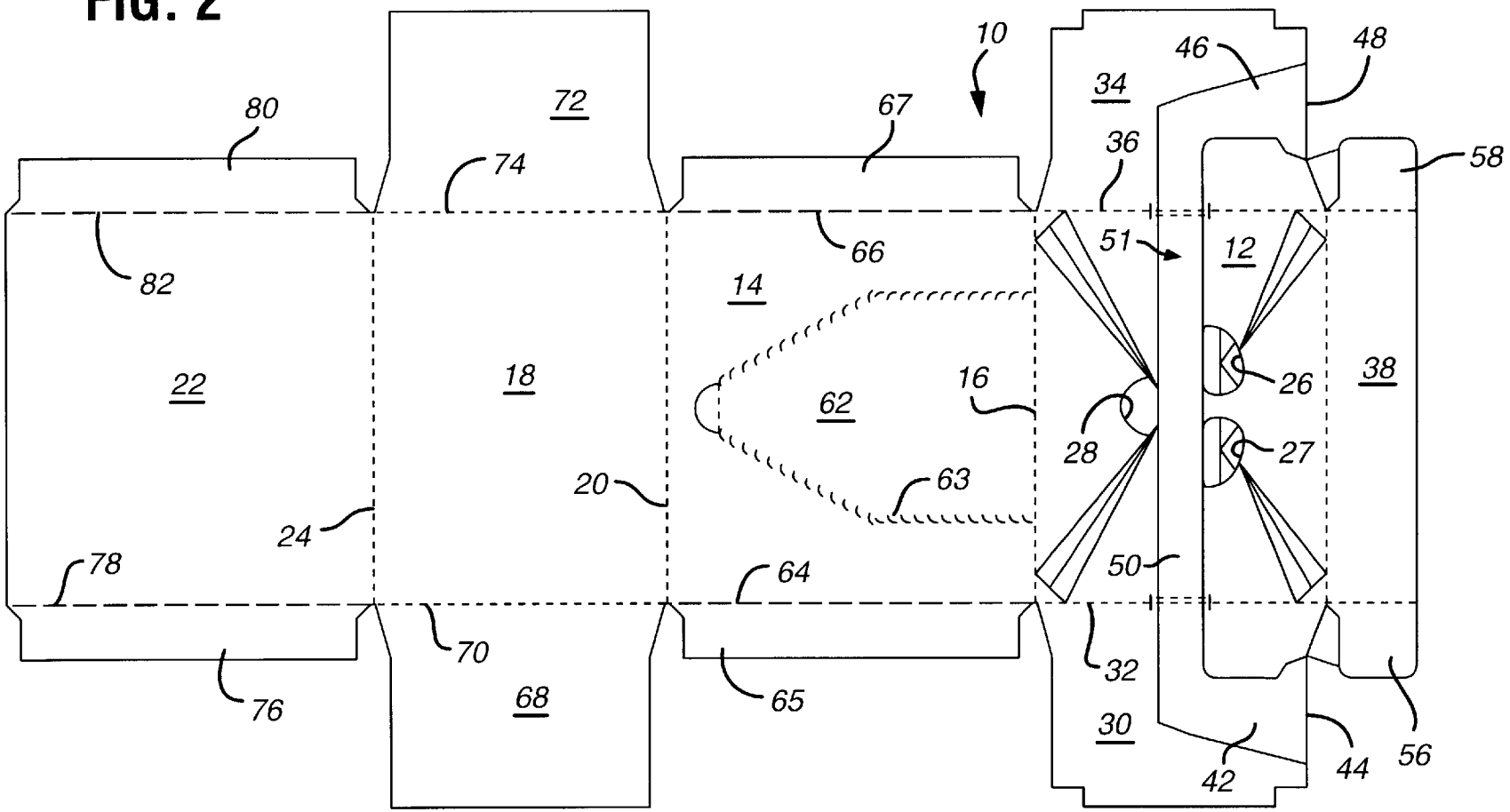
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. The handle reinforcing structure is folded about fold lines 44 and 48, and end portions 42 and 46 are glued to major end panels 30 and 34, respectively. Central portion 50 is glued to top wall panel 12, so as to extend along the region between the finger apertures 26 and 27 and the thumb aperture 28. Thus, a double-ply reinforcing strip 51 between the apertures 26, 27 and 28 is formed.

When central portion 50 is positioned on the underside of central panel 12 as shown in FIG. 2, a notional strip can be defined along central panel 12, extending between its end edges. This notional strip passes between the finger apertures 26 and 27 on one side, and thumb aperture 28 on the opposite side.

Figure 3:
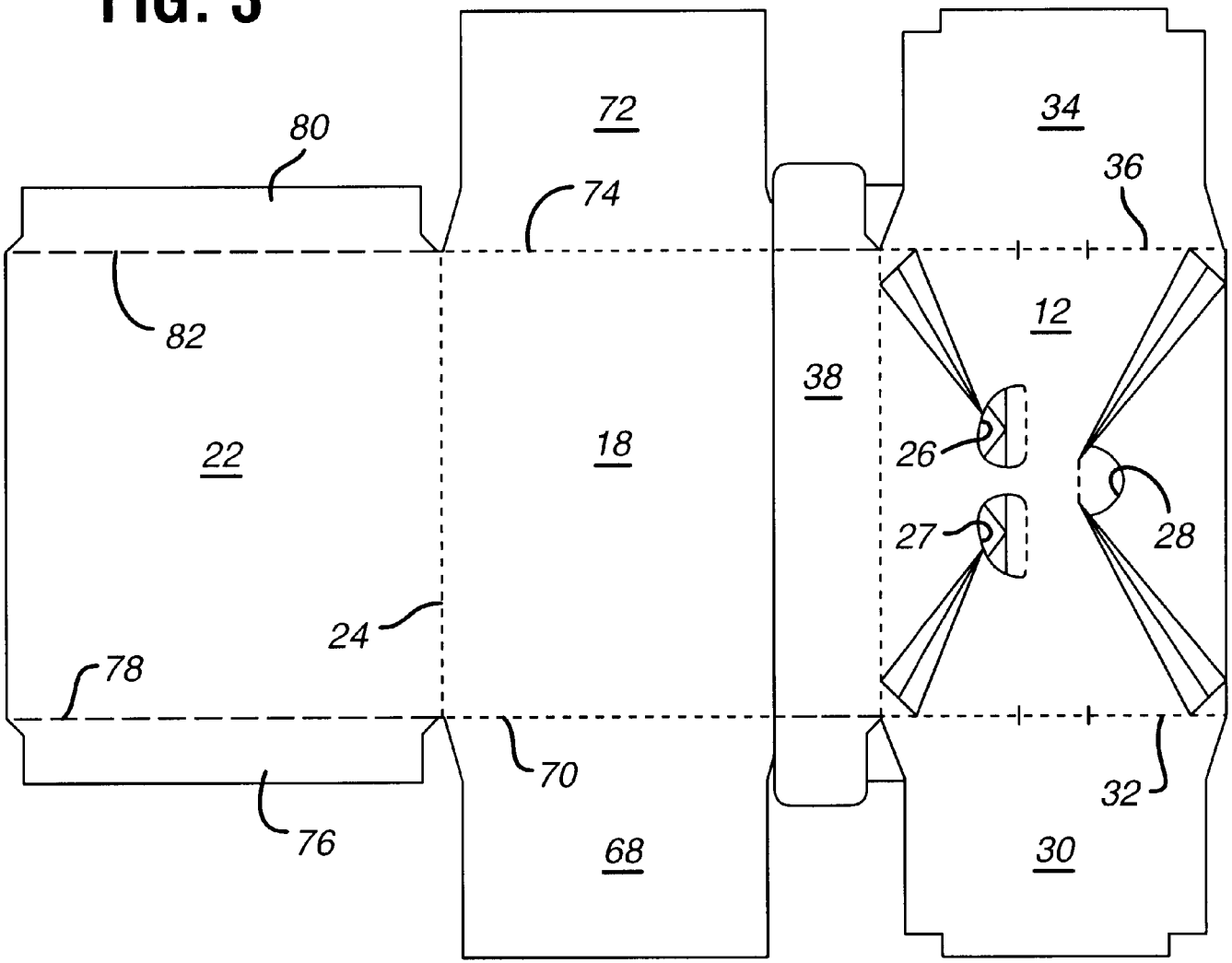
FIGS. 3 and 4 are plan views of the blank of FIGS. 1 and 2, further illustrating the formation of the carton.
Figure 4:
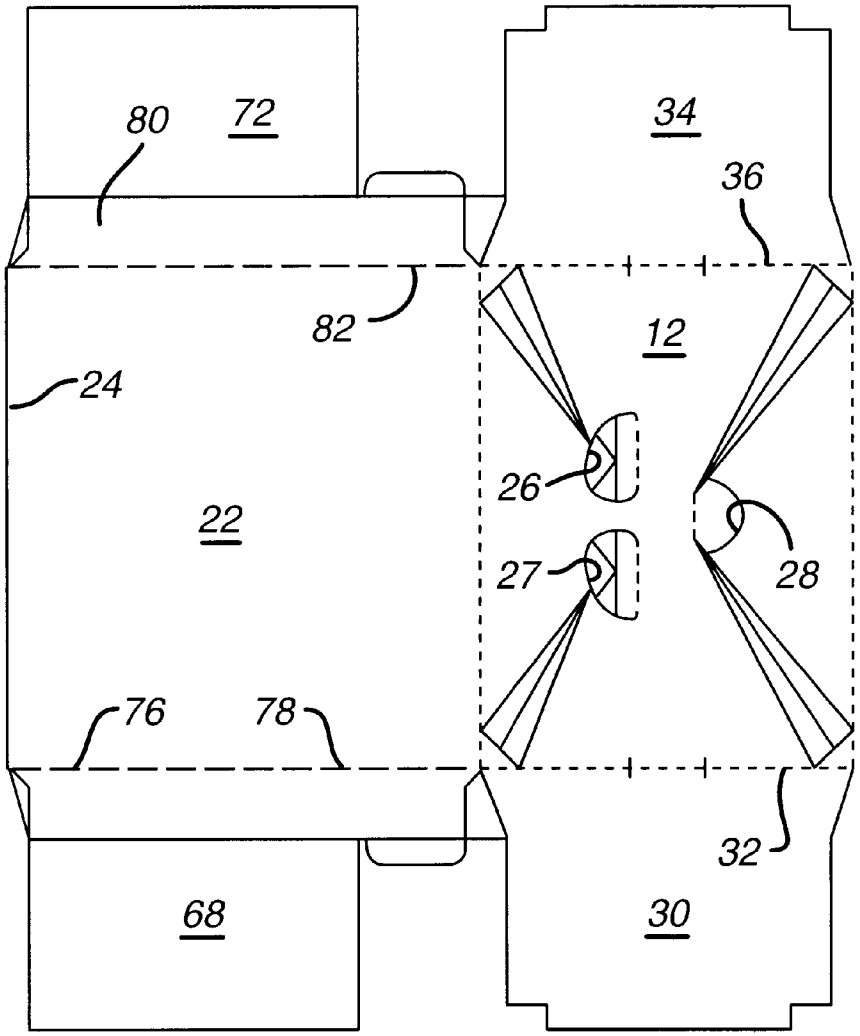

The remainder of the assembly of carton 10 can be seen by reference to FIGS. 3 and 4. In FIG. 3, the top wall panel 12 is shown folded along fold line 16 into overlapping arrangement with side wall panel 14. Glue is applied along glue flap 38 and, as shown in FIG. 4, side wall panel 22 is folded along fold line 24. The upper edge of side wall panel 22 is then adhered to glue flap 38 to complete the collapsed carton.

Figure 5:
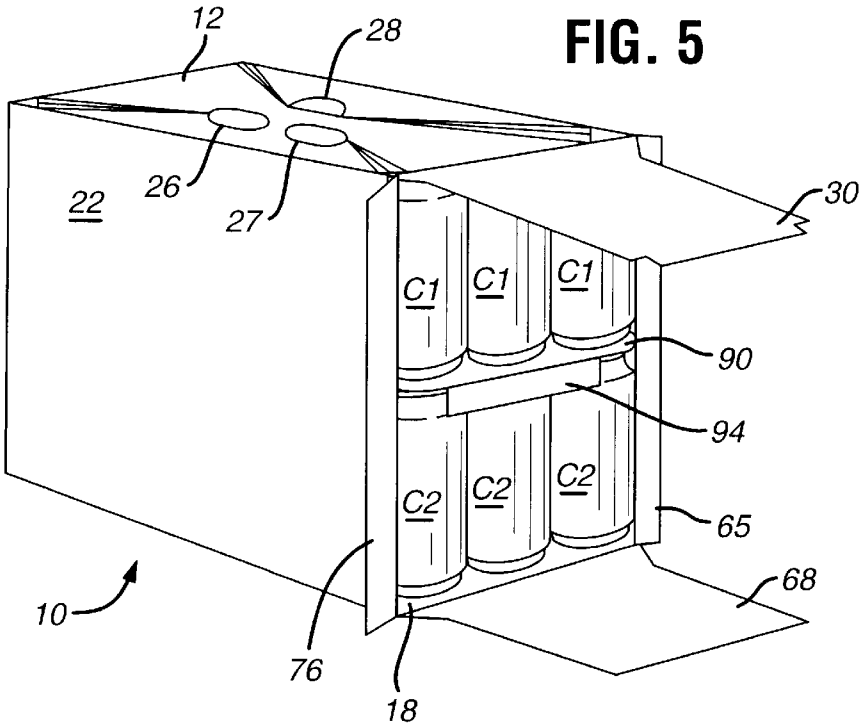
FIG. 5 is a three-quarter view of the top, side and end of an erected and loaded carton formed from the blank of FIG. 1, showing the end closure structure prior to folding and sealing.

The carton is loaded as shown in FIG. 5. First, the carton is erected into a tubular structure. The carton 10 is shown with its end closure structure, comprising major end flaps 30 and 68 and minor end flaps 65 and 76, open prior to the application of glue for sealing. The carton is loaded, as shown here for example, with beverage cans arranged into two tiers. A divider insert 90 is positioned between the tiers. Cans C1 of the upper tier are positioned on insert 90, which in turn rests upon the tops of the cans C2 of the lower tier. Cans C2 are in turn positioned on the bottom wall panel 18 of the carton 10. The can arrangement, as is conventional, is assembled prior to loading, and the stacked and arranged cans are loaded by pushing into the carton tube through one or both of its open ends. Such operation may be carried out by suitable, commercially-available automated packaging machinery.

Closure and sealing of the end closure structure is effected in the following manner. Minor end flaps 65 and 76 are folded to a closed position against the packaged cans. Glue is applied to minor end flaps 65 and 76 and, preferably, to end flap 94 attached along a fold line to the edge of insert 90. Major end flap 30 is then folded downwardly and secured to the flaps 65, 76 and 94. Additional glue is applied to the outer end of the inner surface of major end flap 68, which is folded upwardly and sealed to major end flap 30.

An identical operation is carried out to close and seal end closure structure located at the opposite end of the carton. (In a preferred embodiment of the invention, the carton is loaded from one end only using automated packaging machinery. During such a loading operation, The opposite, non-loaded carton end is closed and sealed before the cans are pushed into the carton.)

Figure 6:
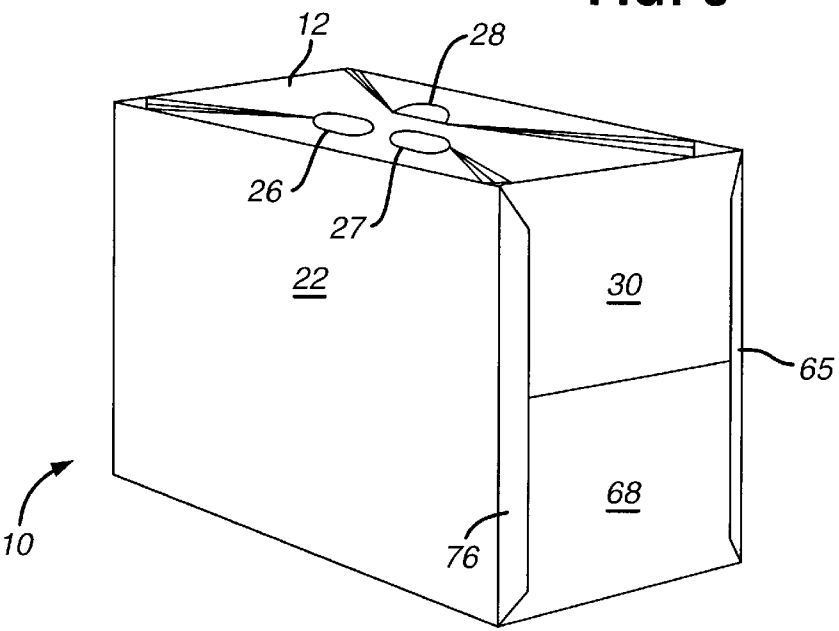
FIG. 6 is a view similar to FIG. 5, but showing the end closure structure sealed to form the finished carton.

The loaded and sealed carton may be seen by reference to FIG. 6.

Figure 7:
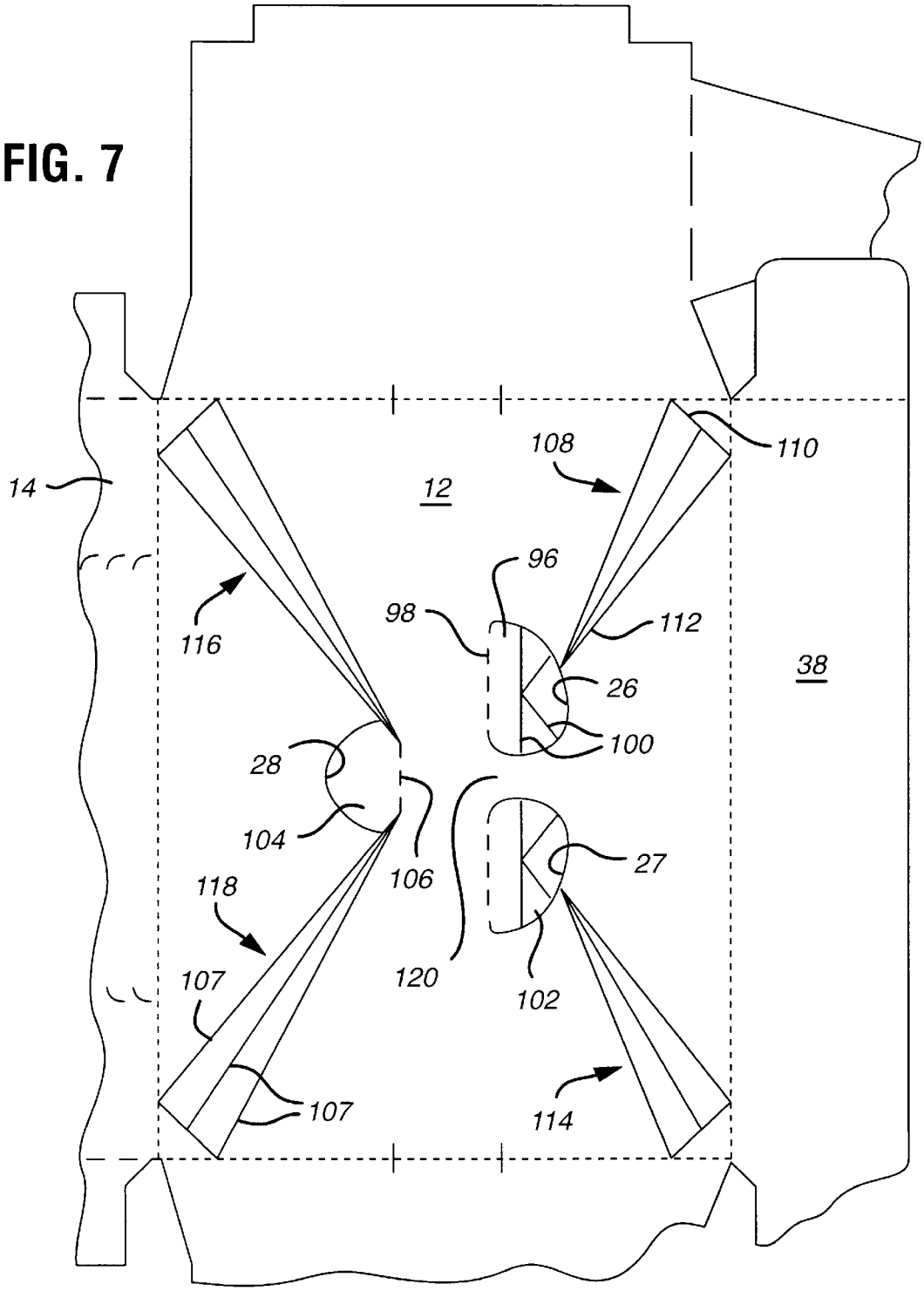
FIG. 7 is an enlarged view of the top panel portion of the blank shown in FIG. 1.

The handle arrangement formed on panel 12 may be seen in greater detail by reference to FIG. 7. A cover flap 96 is disposed over finger aperture 26, connected along one portion of its edge to panel 12 by fold line 98, and connected along its remaining edge portions to panel 12 by nicks (not shown) in a conventional manner. Fold line 98 is generally positioned along the side edge of the underlying central portion 50 of the handle reinforcing strip. A plurality of score lines 100 are formed on cover flap 96. Upon initial use of the handle, the user pushes the flap 26 into the carton, thereby separating the nick connections from panel 12, and pivoting flap 96 along fold line 98. The score lines 100 help direct the user's pushing force to the center of flap 96, thereby making separation along the nicks easier.

A similar flap 102 covers finger aperture 27. Thumb aperture 28 is covered by a flap 104, which is connected to panel 12 along a fold line 106. Fold line 106 is generally positioned along the opposite side edge of the underlying central portion 50 of the handle reinforcing strip from fold lines 98.

A plurality of reinforcing score lines 107 are formed into panel 12 to extend from apertures 26, 27 and 28 toward each corner of top wall panel 12, in accordance with the handle structure disclosed in U.S. Pat. No. 5,307,932, which is incorporated herein by reference. For example, a group 108 of score lines extend in diverging fashion from an edge of finger aperture 26 generally toward the corner of panel 12 adjacent end flap 34 and glue flap 38. A cut line 110 extends diagonally across the corner, at which the group 108 of score lines terminate. In the specific embodiment disclosed, the score lines of group 108 begin at aperture 26 as a single line, and then diverge at a point 112 spaced from the aperture edge. However, an arrangement of the score lines in which the lines begin to diverge immediately from the edge of aperture 26 may be used.

A group 114 of score lines similar to group 108 extends from an edge of finger aperture 27, and two such groups 116 and 118 of score lines extend from the edges of thumb aperture 28, each group toward its respective corner of panel 12.

Still other known arrangements of reinforcing score lines may be used with the handle disclosed herein. In some cases, the score lines may even be eliminated altogether.

It will be seen that the spacing between finger apertures 26 and 27 creates a "bridge" 120 of paperboard material extending from the central region of the handle to the main body of panel 12. In conventional handle aperture arrangements (such as that shown in the above referenced U.S. Pat. No. 5,307,932), in which two elongate slots are disposed adjacent a central strip of material, the user grasps the central strip by reaching into one slots with the fingers and the opposite slot with the thumb. However, in lifting the carton, the user frequently (inadvertently) twists the central strip. This torque can damage the strength of the handle.

In the handle described herein, the bridge 120 prevents twisting of the central strip by connecting along its middle portion to the main body of panel 12. This effectively maintains the handle in tensile stress, rather than in tear stress.

In addition, the lifting stress is distributed over a greater distance along the central strip of material disposed between the apertures. This is because the position of the finger apertures and thumb apertures are such that the user must maintain a separation between the fingers, and the fingers are not aligned with the thumb. Thus, the lifting stress is not concentrated at a small portion of an aperture edge.

It should be readily recognized that while in the preferred embodiment, the present invention has been described in connection with a carton for packaging two tiers of cans, the handle reinforcing structure may also be used with a carton for packaging only a single tier of cans, or for a carton for packaging bottles, jars or other containers or articles. The containers may be oriented vertically, as described herein, or horizontally.

Further, it should be recognized that various handle reinforcing means other than that described herein may be used. For example, rather than a single top panel 12 and the reinforcing structure comprising portions 42, 46 and 50, a lapped top panel of a type generally known in the art may be used. In such an embodiment, the overlap between the two top panel portions forms a double-ply strip which extends down the center of the carton top wall. An example of a carton of this type may be seen in U.S. Pat. No. 5,427,242. which is incorporated herein by reference. The handle structure is formed into the lapped top panel in the same manner as the handle structure described herein, as will be readily appreciated by those skilled in the art.

It will also be recognized that as used herein, directional references such as "top", "bottom", "end" and "side" do not limit the respective panels to such orientation, but merely serve to distinguish these panels one from another.

What is claimed is:

1. A carton formed from sheet material for containers such as cans or bottles, comprising:

a top wall having opposed side edges and opposed end edges;

a pair of side walls, one of the side walls being connected to each said side edge of said top wall;

a bottom wall connecting between said side walls to complete a tubular structure;

a notional strip defined along said top wall and extending between said end edges and having a width less than the distance between said side edges;

a pair of finger apertures defined in said top wall and disposed along one side of said notional strip; and a thumb aperture defined in said top wall and disposed along an opposite side of said notional strip;

wherein said finger apertures define a bridge of said sheet material therebetween and connecting between said notional strip and said top wall;

wherein said thumb aperture is disposed substantially across said notional strip from said bridge.

2. A carton as defined in claim 1, further comprising a reinforcing strip secured to an inner surface of said top panel, said reinforcing strip being disposed generally along said notional strip.

3. A carton as defined in claim 1, wherein said top panel defines therein a first reinforcing score structure extending substantially from a first of said pair of finger holes to an adjacent corner of said top panel, a second reinforcing score structure extending substantially from a second of said pair of finger holes to an adjacent corner of said top panel, and third and fourth reinforcing score structures extending substantially from said thumb aperture to two adjacent corners of said top panel respectively.

4. A carton as defined in claim 3, wherein said reinforcing score structures each include a plurality of score lines defined on said top panel, said score lines arranged to extend from the respective one of said apertures to the respective one of said corners in a diverging arrangement.

5. A carton as defined in claim 1, wherein each of said finger apertures is covered by a cover flap, each said cover flap being connected along one side thereof to said top panel by a fold line.

6. A carton as defined in claim 5, wherein said fold lines connecting said cover flaps to said top panel are disposed generally along an edge of said notional strip.

7. A carton as defined in claim 1, wherein said thumb aperture is covered by a cover flap, said cover flap being connected along one side thereof to said top panel by a fold line.

8. A carton as defined in claim 7, wherein said fold line connecting said cover flap to said top panel is disposed generally along an edge of said notional strip.

9. A carton for packaging articles, comprising a top wall having first and second spaced aperture means disposed to define a handle strip therebetween, said handle strip being provided at opposite ends thereof with first and second junctions through which said handle strip is connected to said top wall, said first aperture means comprising a thumb aperture defined in said top wall and disposed along one side of said handle strip, said second aperture means comprising a pair of spaced finger apertures defined in said top wall and disposed along an opposite side of said handle strip, said finger apertures defining therebetween a bridging strip connected at one end thereof to said handle strip and at the other end thereof to said top wall through a third junction, said third junction being disposed at a location out of alignment with said first and second junctions.

* * * * *